US007755268B2

(12) United States Patent
Chang et al.

(10) Patent No.: US 7,755,268 B2
(45) Date of Patent: Jul. 13, 2010

(54) ELECTRON EMISSION DISPLAY DEVICE HAVING ALIGNMENT MARKS TO ALIGN SUBSTRATES

(75) Inventors: Dong-Su Chang, Suwon-si (KR); Hyeong-Rae Seon, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 847 days.

(21) Appl. No.: 11/442,129

(22) Filed: May 30, 2006

(65) Prior Publication Data

US 2006/0267481 A1 Nov. 30, 2006

(30) Foreign Application Priority Data

May 31, 2005 (KR) ..... 10-2005-0046018

(51) Int. Cl.
*H01J 19/38* (2006.01)
*H01J 63/04* (2006.01)
*H01J 1/62* (2006.01)

(52) U.S. Cl. ..... 313/495; 313/497; 313/498; 445/50

(58) Field of Classification Search ..... None
See application file for complete search history.

(56) References Cited

U.S. PATENT DOCUMENTS

| | | | | |
|---|---|---|---|---|
| 5,649,847 | A | 7/1997 | Haven | |
| 5,771,085 | A | 6/1998 | Ochi et al. | |
| 5,910,830 | A | 6/1999 | Nam | |
| 5,920,151 | A * | 7/1999 | Barton et al. | 313/497 |
| 7,182,877 | B2 | 2/2007 | Murai et al. | |
| 2004/0174114 | A1 * | 9/2004 | Ohishi et al. | 313/495 |

FOREIGN PATENT DOCUMENTS

| | | |
|---|---|---|
| CN | 1 506 718 | 6/2004 |
| CN | 1 564 300 | 1/2005 |
| JP | 2000-238242 A | 9/2000 |

* cited by examiner

*Primary Examiner*—Sikha Roy
*Assistant Examiner*—Tracie Green
(74) *Attorney, Agent, or Firm*—Lee & Morse P.C.

(57) ABSTRACT

An electron emission display device includes first and second substrates facing each other with a non-active area and an active area having a plurality of pixel, a first pixel portion, e.g., an electron emission unit, formed on the first substrate, a second pixel portion, e.g., a light emission unit, formed on the second substrate, and one or more alignment marks formed in the non-active area of at least one of the first and the second substrates and having a pattern substantially similar to that of the plurality of pixels.

20 Claims, 11 Drawing Sheets

ELECTRON EMISSION DISPLAY DEVICE HAVING ALIGNMENT MARKS TO ALIGN SUBSTRATES

BACKGROUND OF THE INVENTION

1. Field of the Invention

The present invention relates to an electron emission display device. More particularly, the present invention relates to an electron emission display device having alignment marks for aligning two substrates facing each other to form a vacuum envelope.

2. Description of the Related Art

Generally, electron emission display devices are classified into a first type using a hot cathode as an electron emission source and a second type using a cold cathode as the electron emission source. Cold cathode electron emission display devices include a metal-insulator-metal (MIM) type, a metal-insulator-semiconductor (MIS) type, a surface conduction emission (SCE) type and a field emitter array (FEA) type.

The MIM type and the MIS type electron emission display devices have electron emission regions with a metal/insulator/metal (MIM) structure and a metal/insulator/semiconductor (MIS) structure, respectively. When voltages are applied to the two metals, or the metal and the semiconductor, on respective sides of the insulator, electrons supplied by the metal or semiconductor on the lower side pass through the insulator due to a tunneling effect and arrive at the metal on the upper side. Of the electrons that arrive at the metal on the upper side, those that have energy greater than or equal to the work function of the metal on the upper side are emitted from an upper electrode.

The SCE type electron emission display device includes first and second electrodes arranged on a substrate parallel to each other, and a conductive film disposed between the first and the second electrodes. Micro-cracks are made in the conductive film to form electron emission regions. When voltages are applied to the first and second electrodes while making an electric current flow to the surface of the conductive film, electrons are emitted from the electron emission regions.

The FEA type electron emission display device is based on the principle that when a material having a low work function or a high aspect ratio is used as an electron emission source, electrons are easily emitted from the material with the application of an electric field thereto under a vacuum atmosphere. A front sharp-pointed tip structure based on, e.g., molybdenum (Mo), silicon (Si) or carbonaceous materials, has been developed to form electron emission regions.

Although the specific structures of the electron emission display devices using the cold cathode are differentiated depending upon the types thereof, they basically have first and second substrates forming a vacuum envelope, and electron emission regions formed on the first substrate together with driving electrodes for controlling the emission of electrons from the electron emission regions. Phosphor layers may be formed on the second substrate for forming an image. An anode electrode may be provided on the second substrate for accelerating the electrons emitted from the first substrate toward the phosphor layers.

In the above-structured electron emission display device, cross-shaped alignment keys may be formed at the peripheries of the two substrates, and the two substrates may be aligned to each other based on the alignment keys.

However, when the two substrates are aligned to each other using the alignment keys, there may be a large distance between the active area where pixels are actually arranged and the alignment keys. If the distance is varied in any way, the electron emission regions and the phosphor layers within the active area may be displaced from each other even though the alignment keys are aligned with each other.

In such a case, the worker cannot check whether the alignment within the active area is made correctly. When the alignment within the active area is not made correctly, the light emission and the display operation of the electron emission display device may be problematic.

SUMMARY OF THE INVENTION

The present invention is therefore directed to an electron emission display device, which substantially overcomes one or more of the disadvantages of the related art.

It is therefore a feature of an embodiment of the present invention to provide an electron emission display device configured to allow alignment of pixels in an active area formed on more than one substrate.

It is another feature of an embodiment of the present invention to extend an opaque layer of the active area structure into a non-active area and provide transparent regions within the non-active area to serve as alignment marks on at least one substrate forming the pixels. The transparent region may have the same structure, i.e., shape and/or pattern, of a pixel portion on that substrate.

It is yet another feature of an embodiment of the present invention to form a dummy region on at least one substrate. The dummy region may have some or all of the elements of a pixel portion formed on that substrate.

At least one of the above and other features and advantages of the present invention may be realized by providing an electron emission display device including first and second substrates facing each other with a non-active area and an active area having a plurality of pixels, a first pixel portion formed on the first substrate, a second pixel portion formed on the second substrate, and one or more alignment marks formed in the non-active area of at least one of the first and the second substrates and having a pattern substantially similar to that of the plurality of pixels.

The non-active area may surround the active area. The alignment marks may be arranged external to a periphery of the active area. The active area may be formed in the shape of a rectangle. The alignment marks may be formed external to two corners of the active area that diagonally face each other, external to four corners of the active area or along portions of opposite sides of the active area.

The second pixel portion may include phosphor layers formed on the second substrate corresponding to pixels and an opaque layer disposed between the respective phosphor layers. The opaque layer may extend into the non-active area forming a first extension and the alignment marks are transparent portions in first extension. The transparent portions may be openings. The second pixel portion may include a phosphor layer corresponding to alignment marks in the first substrate to form the dummy pixel regions, which may be transparent.

The first pixel portion may include electron emission regions, driving electrodes for controlling the emission of electrons from the electron emission regions, and a focusing electrode formed over the driving electrodes. The focusing electrode may extend into the non-active area and the alignment marks may be openings formed in the second extension. The first pixel portion may include at least one of electron emission regions, driving electrodes and the focusing electrode corresponding to alignment marks on the second substrate to form the dummy pixel regions, which may be transparent.

The alignment marks may be first transparent alignment marks on the first substrate and second transparent alignment marks on the second substrate, corresponding to the first transparent alignment marks or dummy pixel regions may be provided on the other substrate corresponding to the alignment marks.

Subsidiary alignment marks may be formed in opaque regions within the active area, e.g., the opaque layer disposed between phosphor layers or at least one of the focusing electrode and the driving electrodes. The subsidiary alignment marks may be holes in the opaque regions.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF INVENTION

Figure 1:
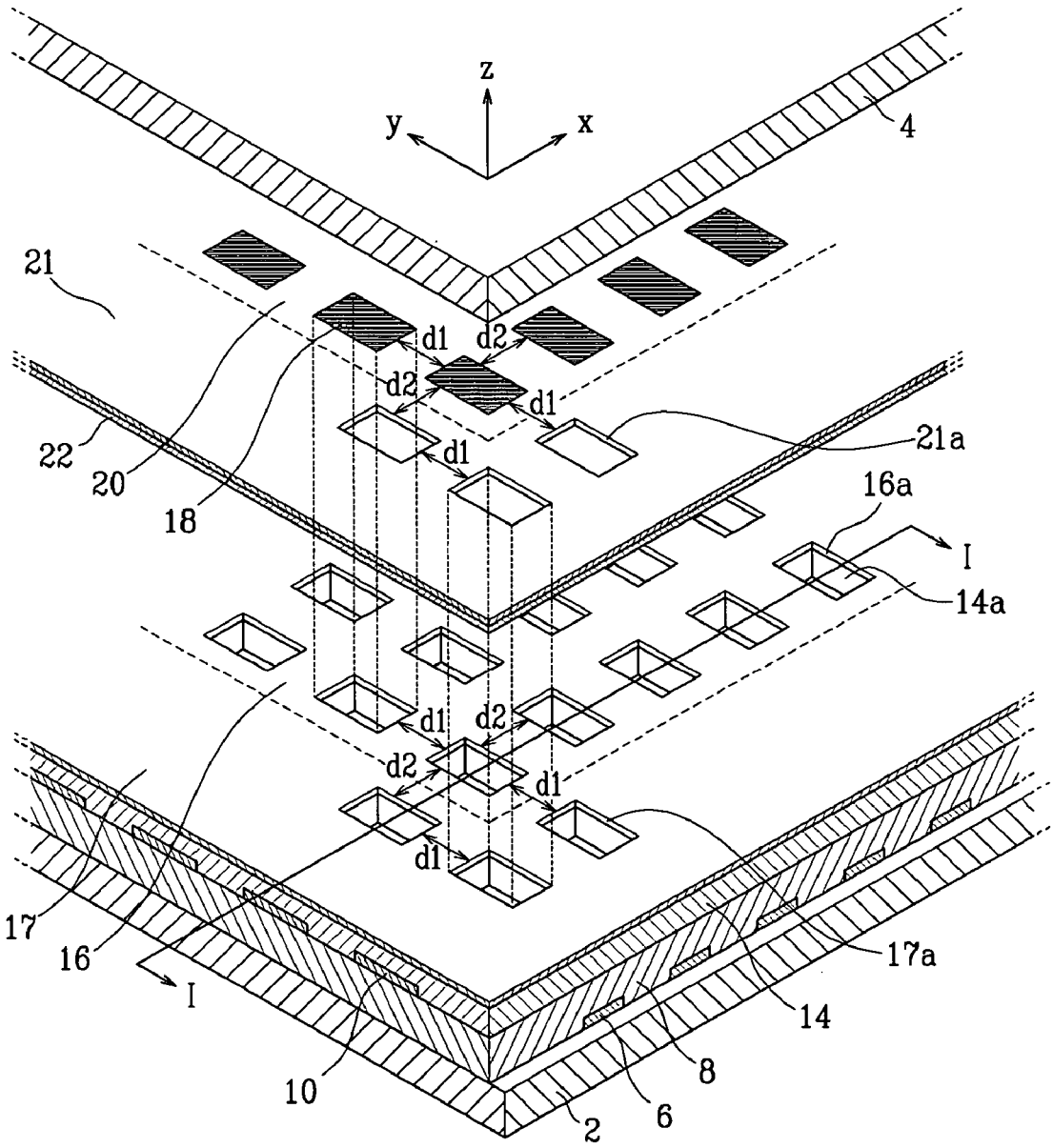
FIG. 1 illustrates a partial exploded perspective view of an electron emission display device according to a first embodiment of the present invention.

Korean Patent Application No. 10-2005-0046018, filed on May 31, 2005, in the Korean Intellectual Property Office, and entitled: "Electron Emission Display Panel" is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
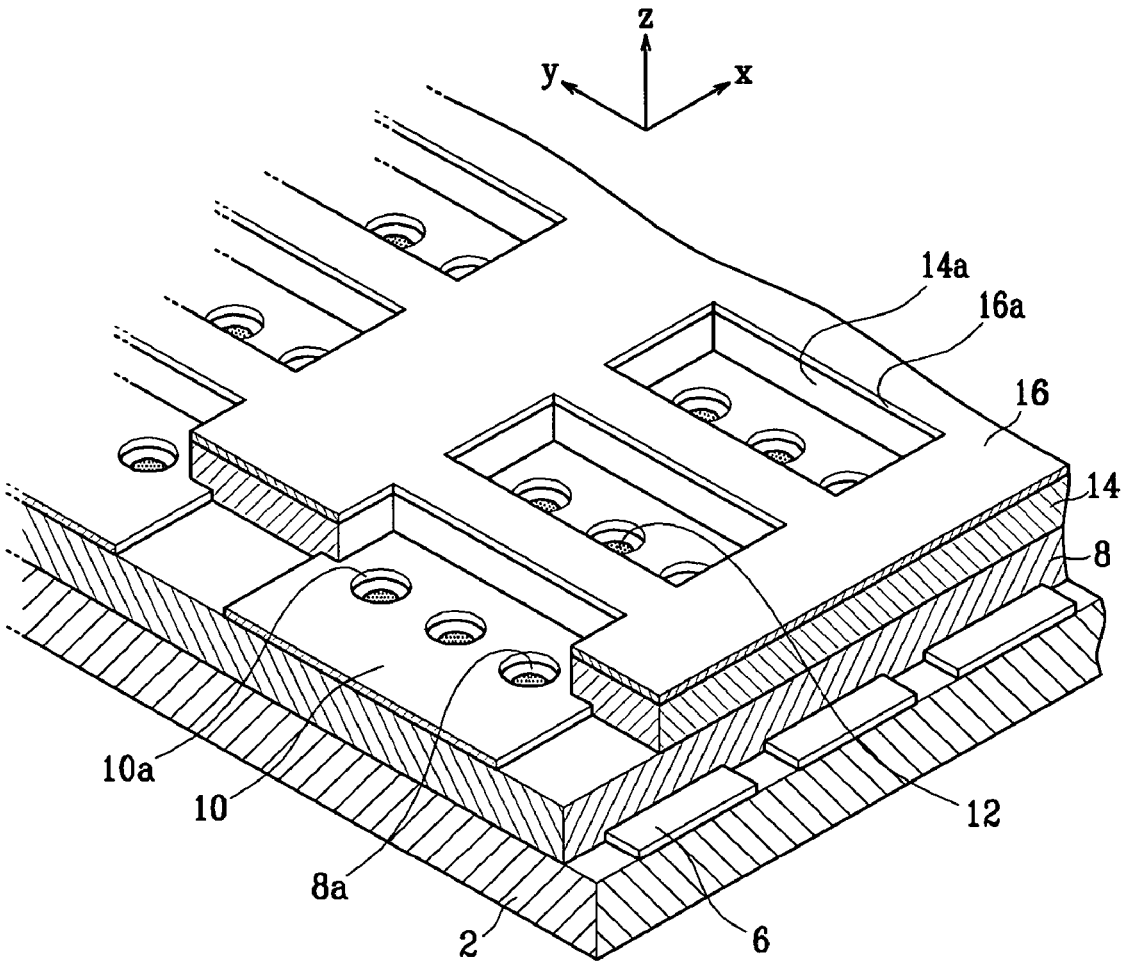
FIG. 2 illustrates a partial sectional perspective view of an electron emission unit for the electron emission display device shown in FIG. 1.

As shown in FIGS. 1 and 2, the electron emission display device according to an embodiment of the present invention may include first and second substrates 2 and 4 arranged parallel to each other with an inner space therebetween. Elements forming a pixel may be formed within the inner space on both the first and second substrates 2 and 4, so alignment therebetween is critical. For example, an electron emission unit may be provided on the first substrate 2 to emit electrons and a light emission unit may be provided on the second substrate 4 to emit visible light due to the electrons, thereby causing the light emission or display.

In the electron emission unit, cathode electrodes 6 may be stripe-patterned on the first substrate 2, e.g., in the direction of the y axis of the drawing. A first insulating layer 8 may be formed on the entire surface of the first substrate 2 to cover the cathode electrodes 6. Gate electrodes 10 may be stripe-patterned on, e.g., the first insulating layer 8 perpendicular to the cathode electrodes 6 (in the direction of the x axis of the drawing).

The crossed regions of the cathode and the gate electrodes 6 and 10 define pixel regions. One or more electron emission regions 12 may be formed on the cathode electrodes 6 at the respective pixel regions. Openings 8*a* and 10*a* may be formed at the first insulating layer 8 and the gate electrodes 10 corresponding to the respective electron emission regions 12, and may expose the electron emission regions 12.

In FIGS. 1 and 2, the electron emission regions 12 are circular and arranged linearly along the length of the cathode electrodes 6 at the respective pixel regions. However, the shape of the electron emission regions 12, the number of the electron emission regions 12 per pixel region, and the arrangement of the electron emission regions 12 are not limited to those illustrated, but may be altered in various manners.

The electron emission regions 12 may be formed with a material for emitting electrons under the application of an electric field, e.g., a carbonaceous material or a nanometer-sized material. The electron emission regions 12 may be formed with, e.g., carbon nanotubes, graphite, graphite nanofiber, diamond, diamond-like carbon, fullerene ($C_{60}$), silicon nanowire, or any suitable combination thereof.

The gate electrodes 10 are shown in FIGS. 1 and 2 as being over the cathode electrodes 6 with the first-insulating layer 8 interposed therebetween. However, the cathode electrodes 6 may also be placed over the gate electrodes 10. In this structure, the electron emission regions 12 would contact a lateral side of the cathode electrodes 6 on the first insulating layer 8.

In the electron emission display device according to an embodiment of the present invention, a second insulating layer 14 and a focusing electrode 16 may be formed on the gate electrodes 10 and the first insulating layer 8. Openings 14*a* and 16*a* may also be formed at the second insulating layer 14 and the focusing electrode 16 such that they expose the electron emission regions 12 on the first substrate 2. One each of openings 14*a* and 16*a* maybe provided at the respective pixels. The focusing electrode 16 may be formed on the entire surface of the first substrate 2 while covering the second insulating layer 14 as shown, or, alternatively, may be patterned with a plurality of portions.

The light emission unit may include phosphor layers 18 for forming an image and an opaque, e.g., black, layer 20 for enhancing the screen contrast formed on a surface of the second substrate 4 facing the first substrate 2. An anode electrode 22 may be formed on the phosphor layers 18 and the black layer 20, and may be a transparent conductive material, e.g., indium tin oxide (ITO), or a metallic material, e.g., aluminum. The phosphor layers 18 may be individually provided at the respective pixel regions defined on the first substrate 2, as shown in FIG. 1. A complete pixel may be formed when pixel portions, here, the electron emission unit and the light emission unit, on respective substrates are correctly aligned.

The anode electrode 22 may receive a high voltage for accelerating the emitted electrons and may reflect visible light output from the phosphor layers 18 in the direction of the first substrate 2 back through the second substrate 4, thereby increasing screen brightness. When the anode electrode is a transparent conductive material, the anode electrode 22 may be placed on a surface of the phosphor layers 18 and the black layer 20 facing the second substrate 4, and patterned in a plurality of portions.

The electron emission display device according to the present embodiment may include a plurality of alignment marks placed on at least one of the first and the second substrates 2 and 4. That is, the alignment marks may be formed at only one of the first and the second substrates 2 and 4, or at both the first and the second substrates 2 and 4. In the former case, structural components corresponding to the alignment marks may be formed at the other substrate such that they serve as alignment reference for the alignment marks, i.e., when an alignment mark is not to be on a substrate, one or more of the elements making up the pixel portion on that substrate may be formed outside the active area as "dummy pixel regions." As used herein, "alignment marks" refer to transparent portions in an opaque region to be used during alignment and "alignment reference" are not transparent portions in an opaque region, but may be viewed through the alignment marks to aid in alignment.

The case where alignment marks 24 are formed on the second substrate 4 will be first explained with reference to FIG. 3. The first and second substrates 2 and 4 may be demarcated into an active area provided with the electron emission unit and the light emission unit, and a non-active area surrounding the active area. Pixels may be arranged in the active area to display the desired images.

The alignment marks 24 may be formed at the non-active area of the second substrate 4, and may be substantially patterned after the phosphor layers 18 such that the alignment of the pixels arranged within the active area can be checked from the side external to the periphery of the active area. In other words, the alignment mark(s) may have the same shape as a pattern in an opaque layer on the second substrate 4, here, the phosphor layer 18. If more than one alignment mark is to be used, the alignment marks may also be provided in a same arrangement as this patterned element.

Specifically, each alignment mark 24 may be formed as a transparent portion in a first extension 21, i.e., where the black layer 20 extends into the non-active region. The transparent portion may be made by forming an opening portion 21*a* in the extension 21. The dotted line of FIG. 1 distinguishes the black layer 20 and the first extension 21.

The openings 21*a* may have the same pattern as that of the phosphor layers 18. That is, the distance between the openings 21*a* may be the same as the distance between the phosphor layers 18, and their shape may be the same. As shown in the FIG. 1, the distance between the respective phosphor layers 18, the distance between the phosphor layer 18 and the opening portion 21*a*, and the distance between the respective openings 21*a* may all be indicated by d1 (the distance in the direction of the y axis of the drawing) and d2 (the distance in the direction of the x axis of the drawing), and the shapes thereof may all be rectangular.

Furthermore, as shown in FIG. 1, the first extension 21 may extend around the entire periphery of the black layer 20. Alternatively, the first extension 21 may be present only where the alignment mark 24 is to be formed.

Figure 3:
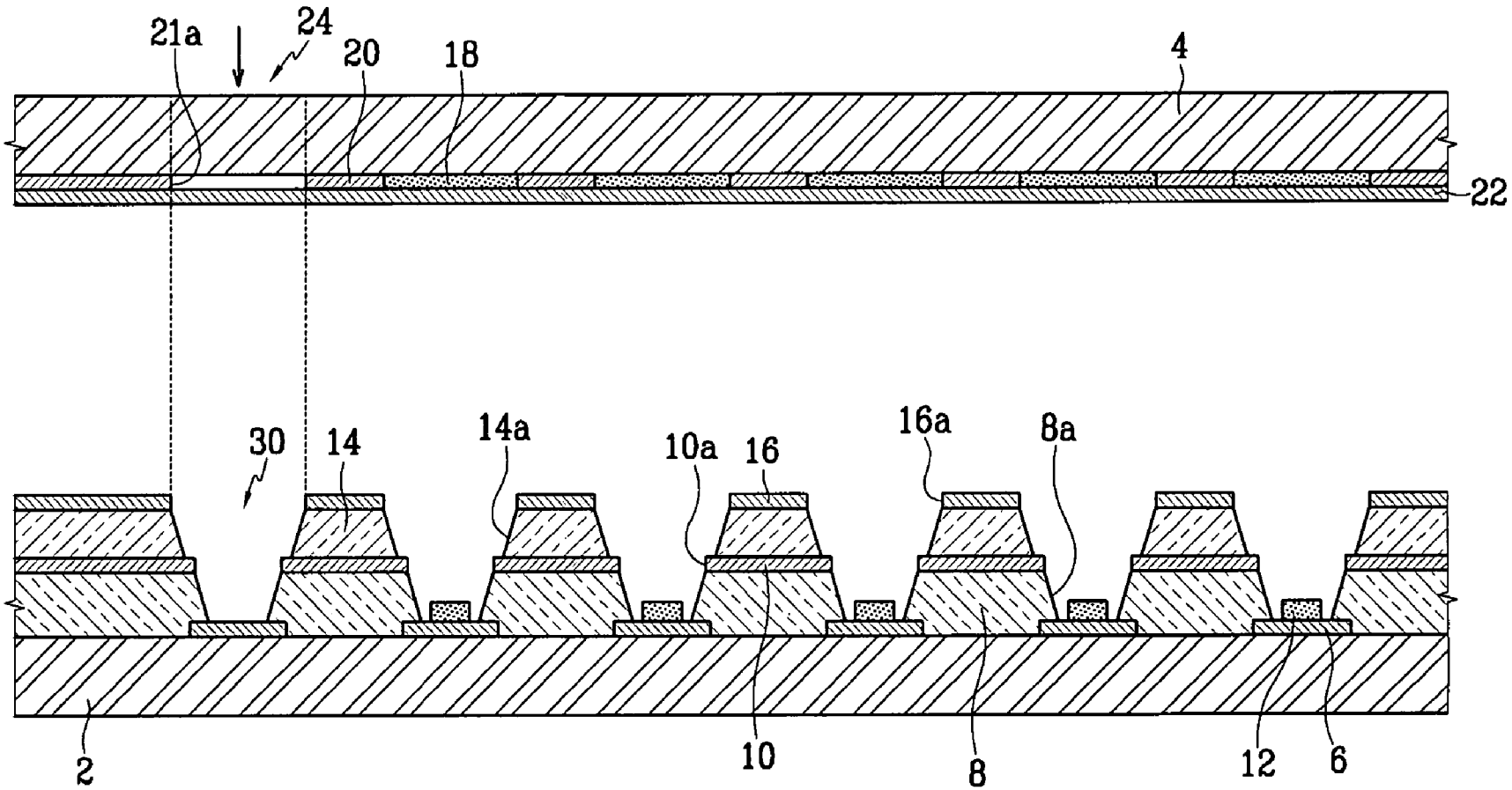
FIG. 3 illustrates a partial cross-sectional view of the electron emission display device taken along the line I-I of FIG. 1.

As shown in the FIG. 3, when the anode electrode 22 is formed with a transparent conductive material, the anode electrode 22 may traverse the openings 21*a*. Otherwise, the anode electrode 22 may be provided with openings corresponding to the openings 21*a* formed at the first extension 21.

When the alignment marks 24 are formed only on the second substrate 4, dummy pixel regions 30 may be formed on the first substrate 2 to serve as an alignment reference for the alignment marks 24. As shown in FIG. 3, the dummy pixel regions 30 may correspond to the alignment marks 24 in the direction of the thickness (the distance in the direction of the z axis of the drawing) of the first substrate 2.

Specifically, the dummy pixel regions 30 may be formed at the extension of the electron emission unit extended into the non-active area. The dummy pixel regions 30 may be formed with all the components of the electron emission unit, i.e., the cathode electrode 6, the gate electrode 8, the first and second insulating layers 8 and 14, the electron emission region 12 and the focusing electrode 16, but is not limited thereto. That is, some of these components, e.g., the electron emission region 12, already omitted in FIG. 3, and the cathode electrode 6, may be omitted.

While the above explanation is directed to a structure having the focusing electrode 16, dummy pixel regions 30 may still be employed as alignment references for the alignment marks 24. That is, when alignment marks are formed on the second substrate 4, the alignment reference of the alignment marks 24 may be needed on the first substrate 2. The alignment reference may be provided by the dummy pixel regions 30 provided that they are alignment reference indicators, irrespective of the presence or absence of the cathode electrode, the electron emission region and the focusing electrode.

Figure 4:
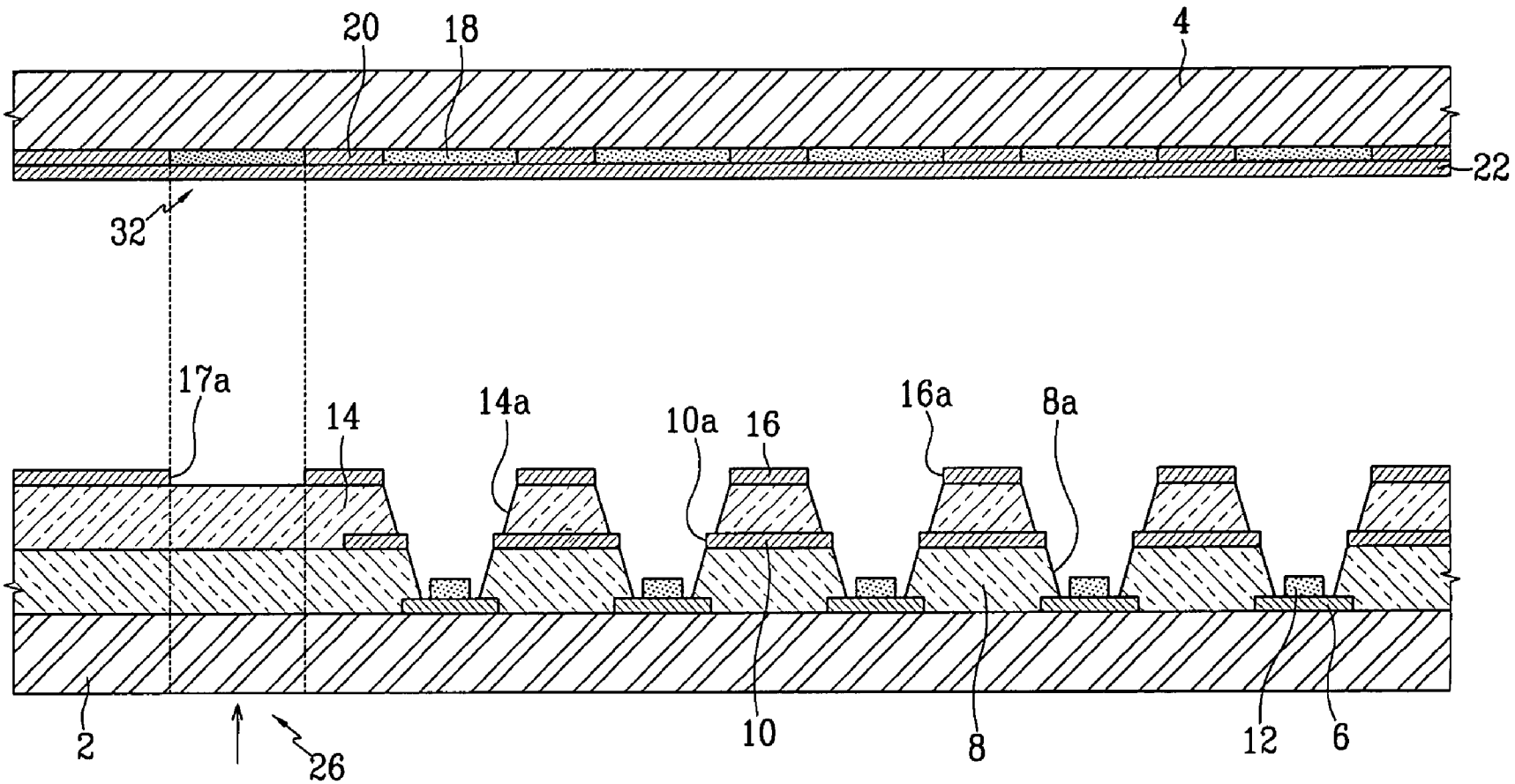
FIG. 4 illustrates a partial cross-sectional view of an electron emission display device according to a second embodiment of the present invention.

The case where alignment marks 26 are formed only at the first substrate 2 will now be considered with reference to FIG. 4. The location and distance of the alignment marks are the same as those explained above, and hence, only new features thereof will be now explained.

As shown in FIG. 4, with the electron emission display device according to an embodiment of the present invention, openings 17*a* may be formed in a second extension 17, i.e., where the focusing electrode 16 extends into a non-active region, thereby forming alignment marks 26. The focusing electrode 16 and the second extension 17 may be distinguished from each other by the dotted line of FIG. 1. The second extension 17 may fully surround the focusing electrode 16 or may extend only in a region in which alignment marks are to be formed.

The alignment marks 26 may have the same shape as a pattern in an opaque layer on the first substrate 2, here, spaces between the focusing electrode 16. If more than one alignment mark is to be used, the alignment marks may also be provided in a same arrangement as this patterned element.

The first insulating layer 8, the second insulating layer 14 and the first substrate 2 may be placed below the openings 17*a* formed at the second extension 17. When the first substrate 2 and the first and the second insulating layers 8 and 10 are transparent, the alignment of the first and second substrates 2 and 4 can be checked through the alignment mark 26 from the bottom of the first substrate 2, as indicated by the arrow in FIG. 4. Similarly, if cathode electrodes 6 are transparent, they may be formed below the openings 17*a* of the second extension 17. That is, transparent structures may be formed below the openings 17*a*.

Dummy pixel regions 32 may be formed on the second substrate 4 corresponding to the alignment marks 26. The dummy pixel regions 32 may be formed by providing phosphor layers with the same shape and pattern as those of the openings 17*a* of the second extension 17.

Figure 5:
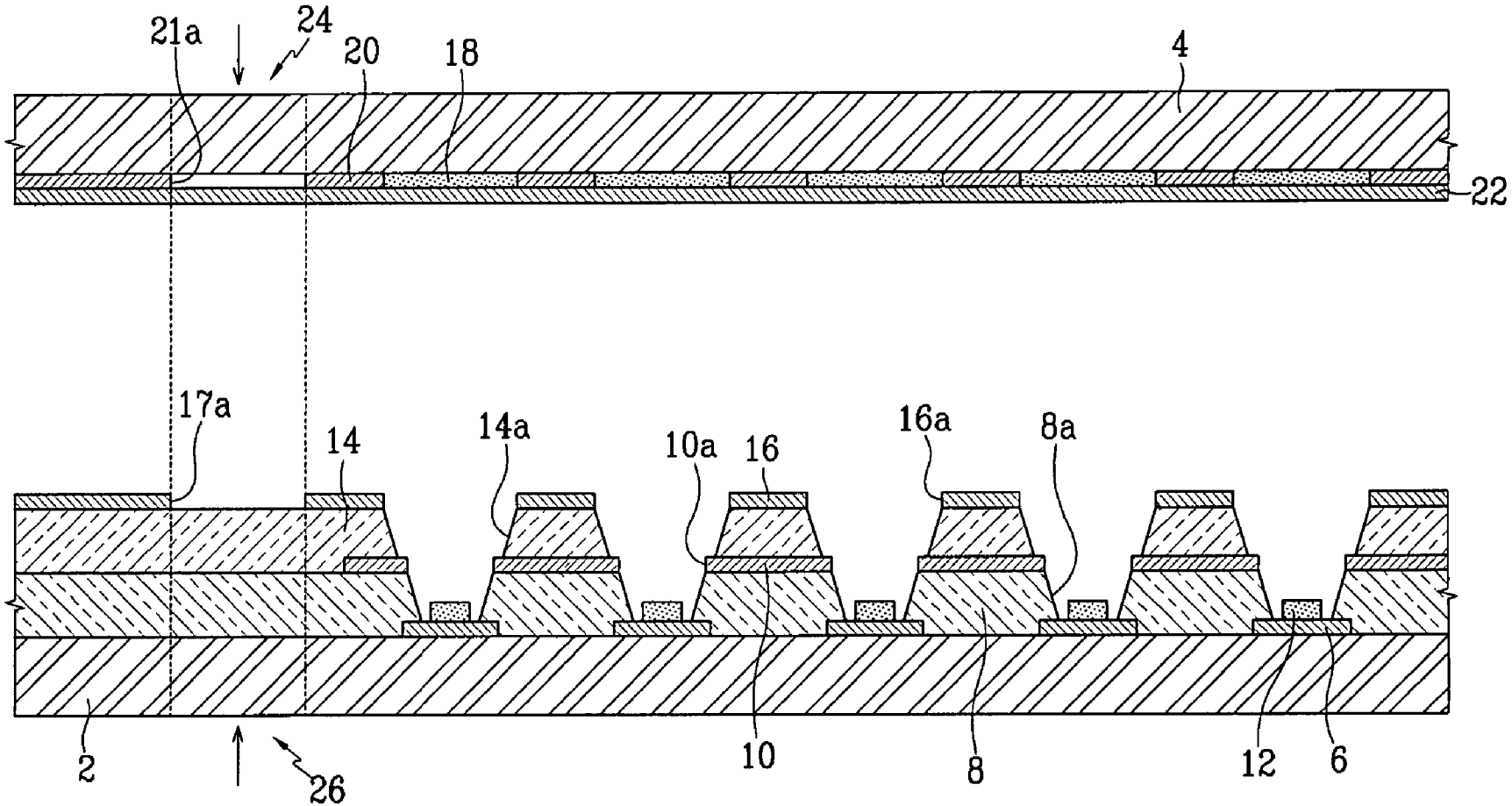
FIG. 5 illustrates a partial cross-sectional view of an electron emission display device according to a third embodiment of the present invention.

As shown in FIG. 5, the alignment marks 24 and 26 may be formed on both the first and the second substrates 2 and 4. Accordingly, a worker can check the alignment state from both sides of the first and the second substrates 2 and 4, as indicated by the arrows in FIG. 5.

As shown in FIGS. 6 to 9, the alignment marks M may be variously patterned outside the active area A and patterned after the pixel regions P within the active area A. The active area A may be, e.g., a rectangle.

Figure 6:
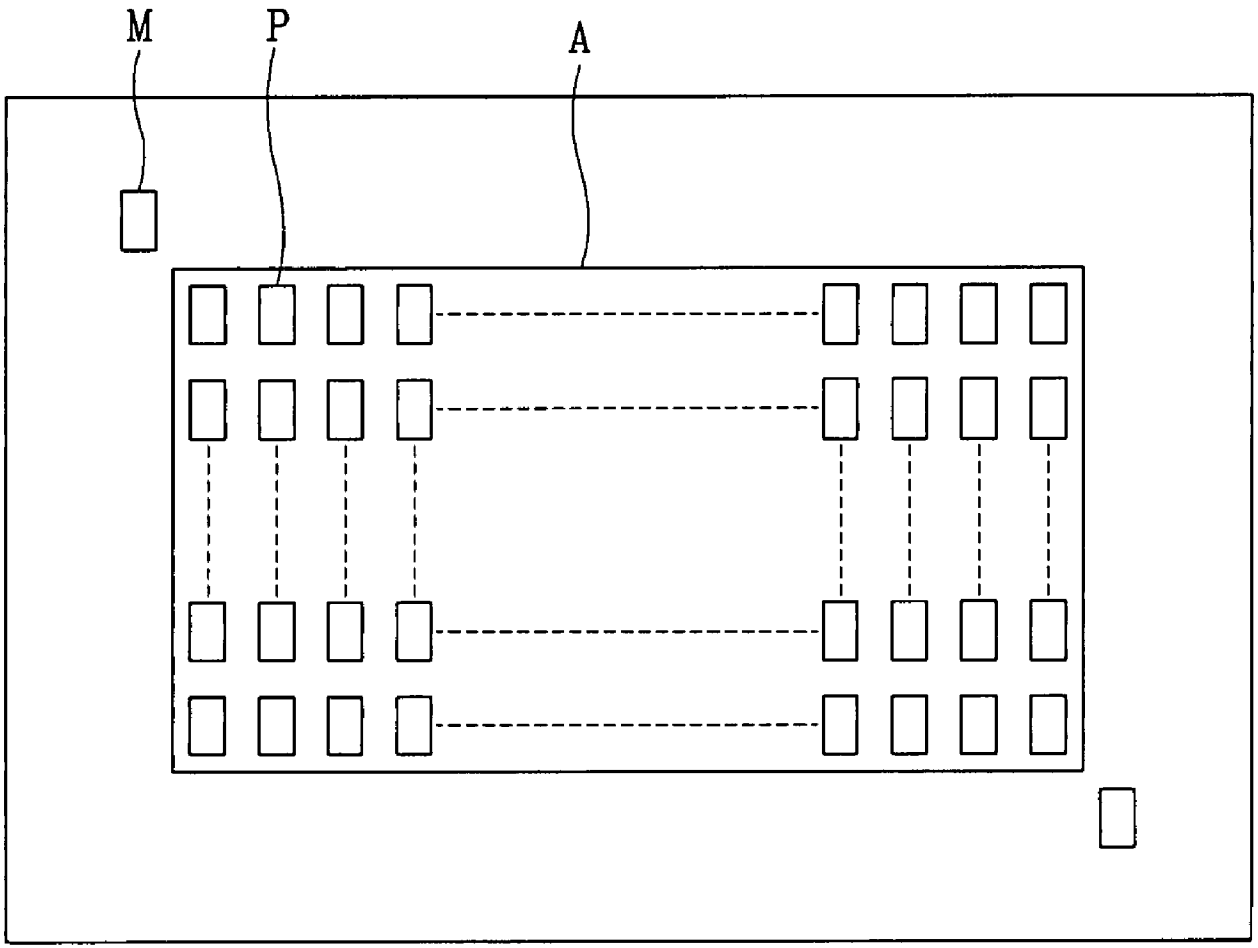
FIGS. 6 to 9 illustrate plan views of various patterns of alignment marks.
Figure 7:
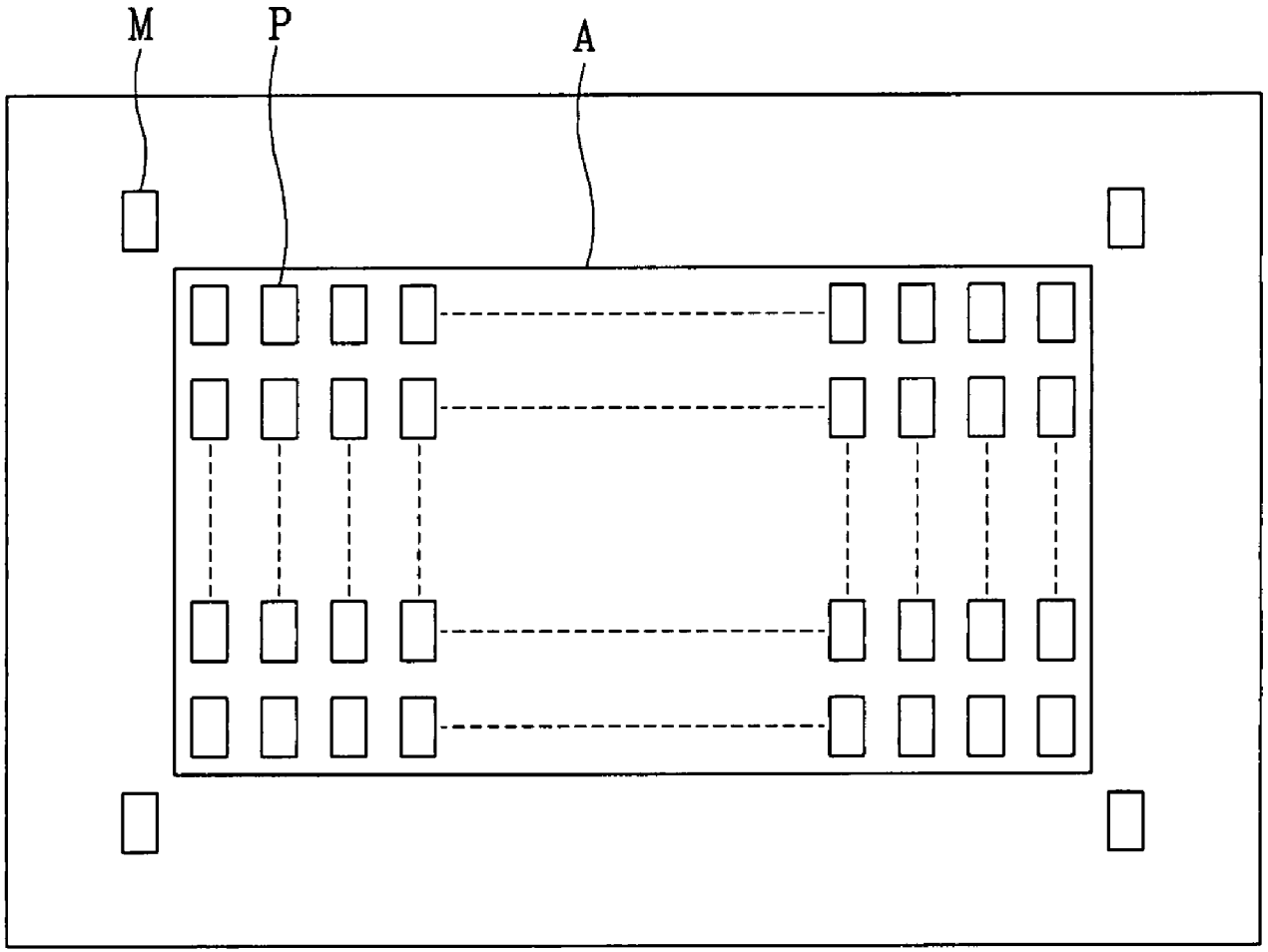
Figure 8:
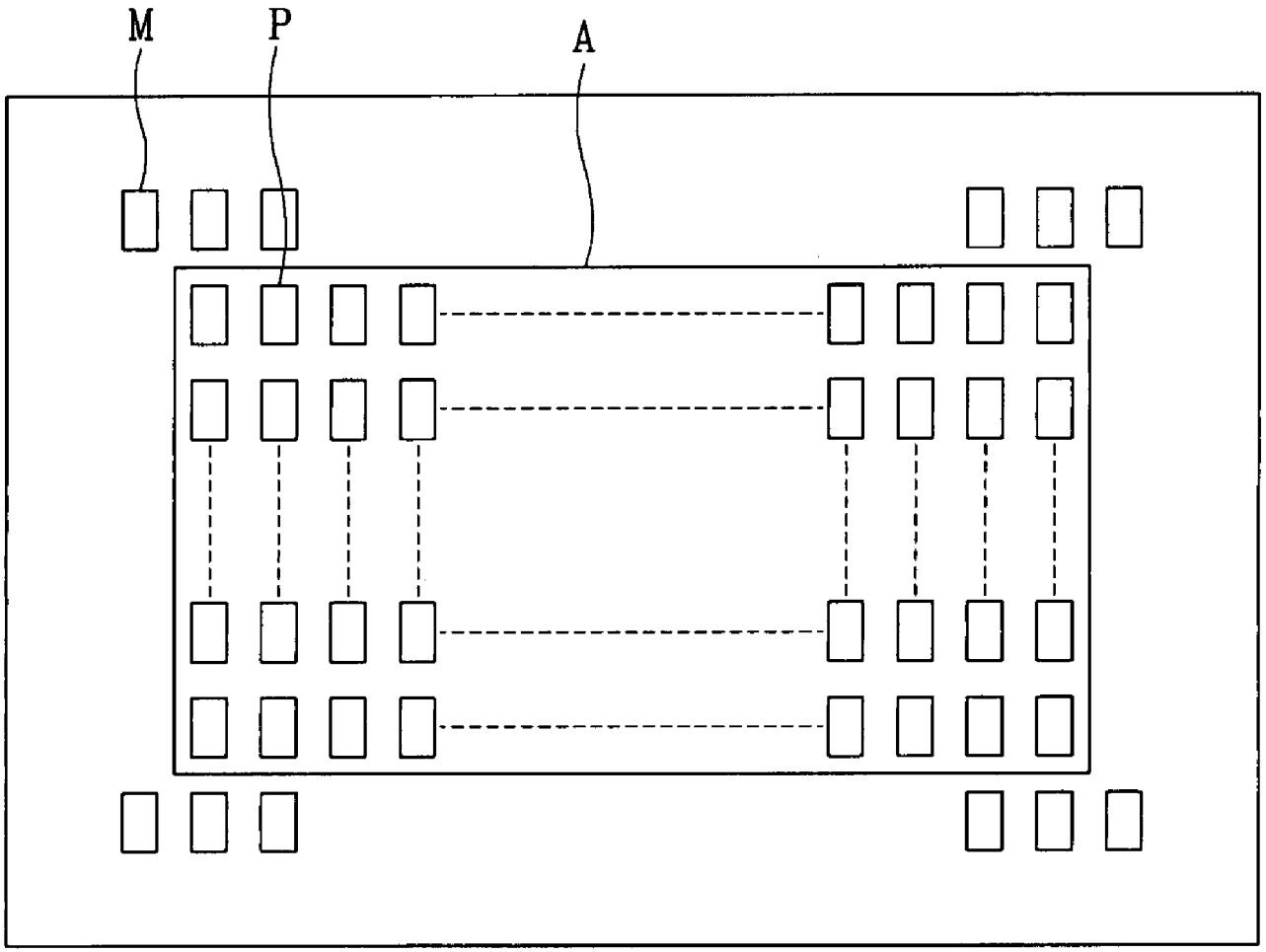
Figure 9:
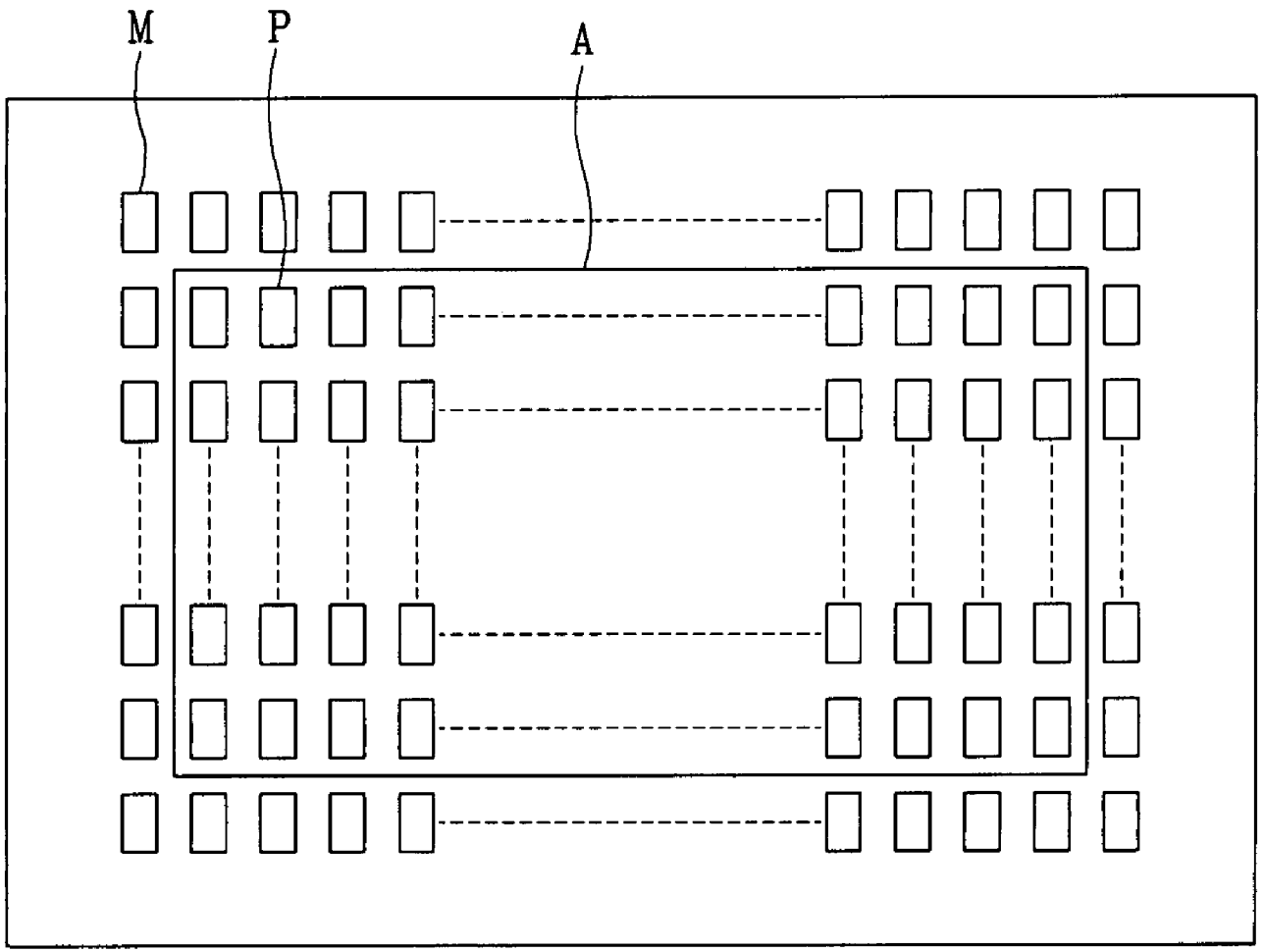

As shown in FIG. 6, the alignment marks M may be formed outside two corners of the active area A diagonally facing each other, or, as shown in FIG. 7, may be formed outside four corners of the active area A. Further, as shown in FIG. 8, the alignment marks M may be formed along portions of opposite sides of the active area A, or, as shown in FIG. 9, may be formed around the entire active area A. The pattern of the alignment marks M is not limited to the illustrated regular arrangement, and may be an irregular arrangement provided that the pattern of the pixels is maintained.

Figure 10:
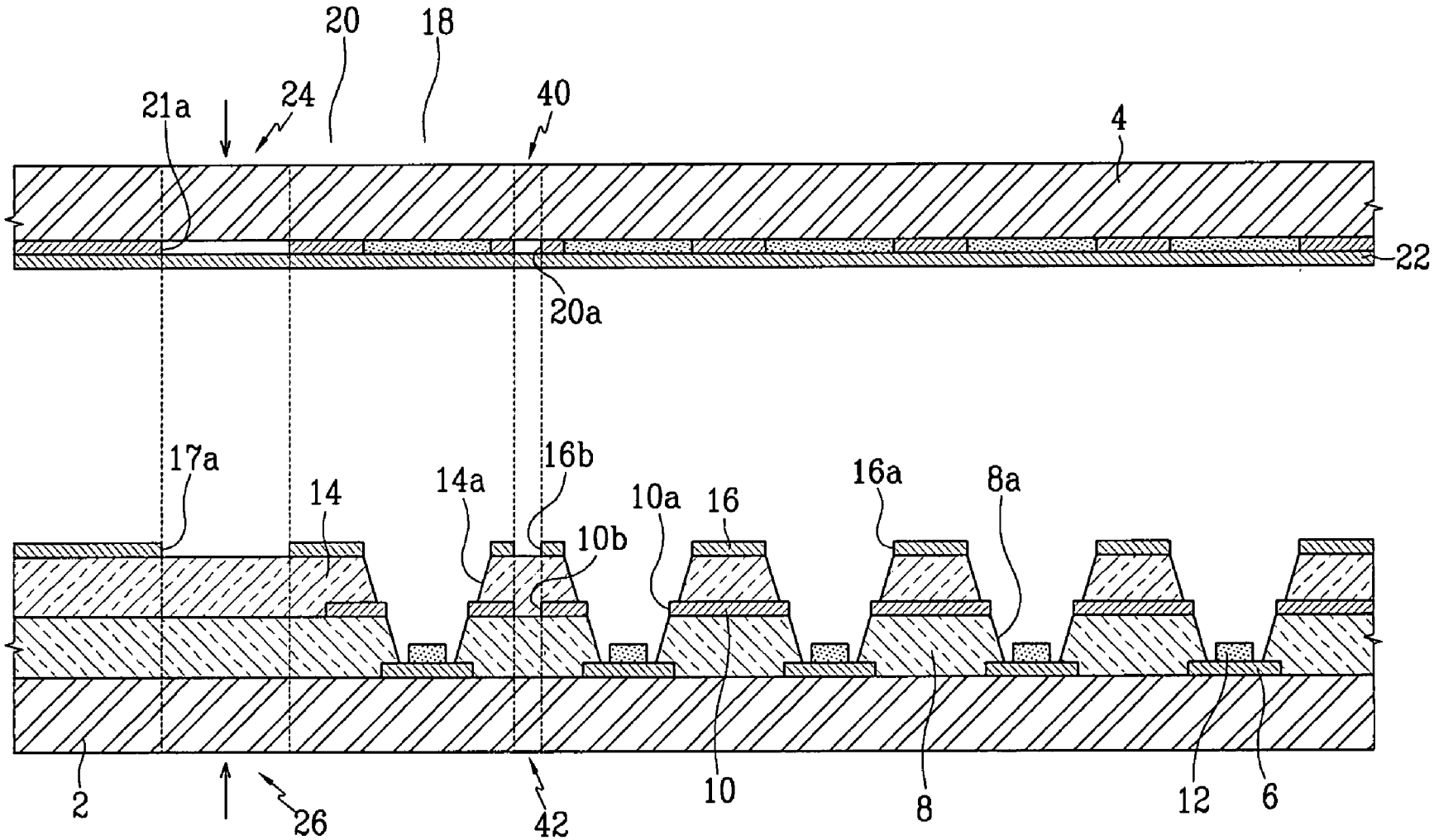
FIG. 10 illustrates a partial sectional view of an electron emission display device according to a fourth embodiment of the present invention.

Furthermore, subsidiary alignment marks may be provided within the active area together with the alignment marks formed at the non-active area. As shown in FIG. 10, subsidiary alignment marks 40, 42 may be formed at opaque regions within the active area, e.g., at the black layer 20 on the second substrate 4 or at other structures on the first substrate 2 corresponding thereto. Specifically, when on the second substrate 4, the subsidiary alignment marks 40 may be holes 20*a* in the black layer 20. When on the first substrate 2, the subsidiary alignment marks 42 may be holes 16*b* and 10*b* at the portions of the focusing electrode 16 and the gate electrodes 10 corresponding to the black layer 20 in the direction of the thickness of the first substrate 2.

Figure 11:
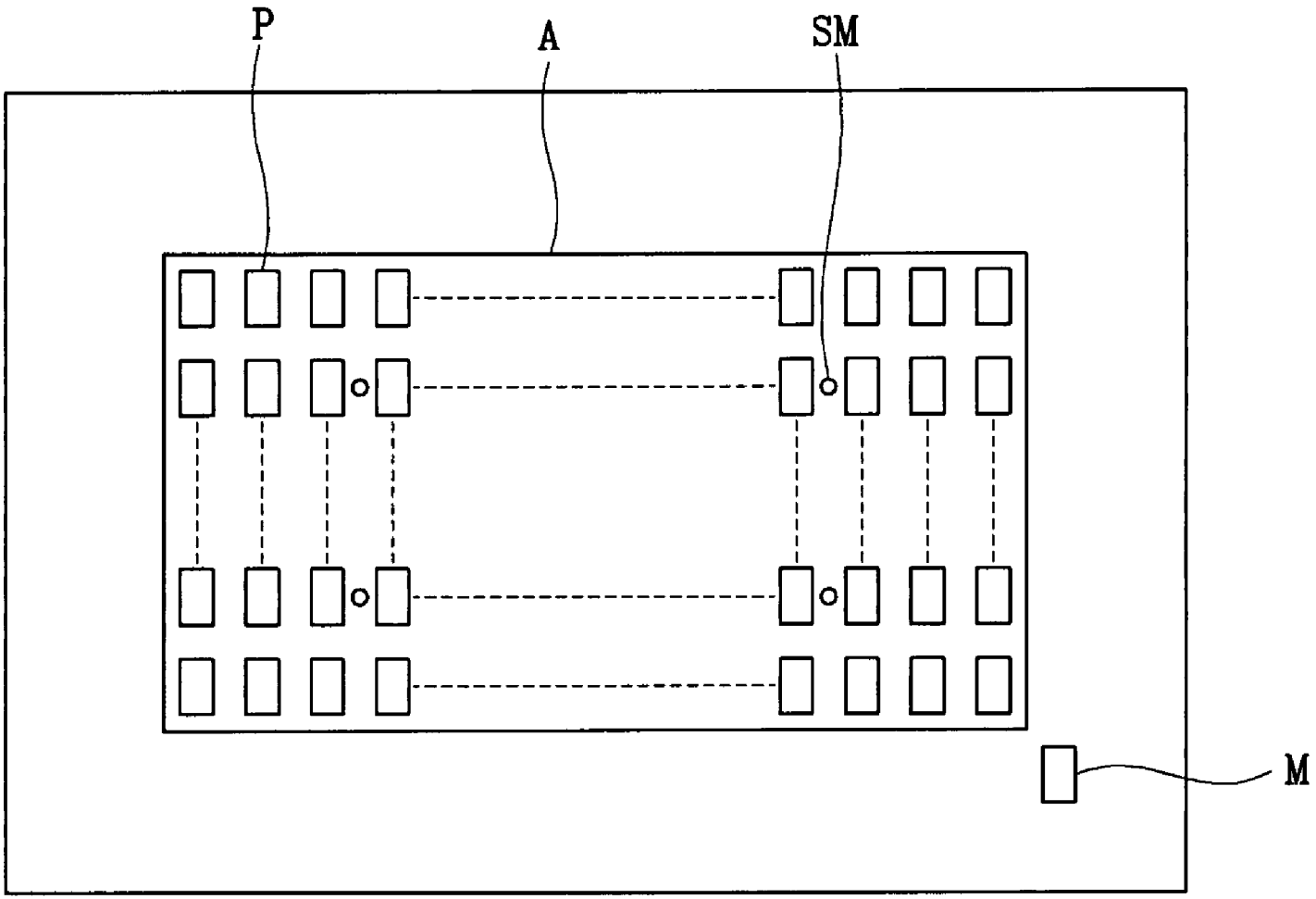
FIG. 11 illustrates a plan view of a pattern of subsidiary alignment marks.

As shown in FIG. 11, the subsidiary alignment marks SM may be formed in the shape of a circle, and may be patterned between the pixels P within the active area A. However, the shape and arrangement of the subsidiary alignment marks SM are not limited thereto, and may be altered in various manners.

As described above, with the present invention, subsidiary alignment marks may be provided together with the alignment marks, thereby making the alignment within the active area more precise.

The above explanation has been provided relative to the FEA-type electron emission device in which electron emission regions may be formed with a material emitting electrons under the application of an electric field. However, the inventive structure is not limited to the FEA-type electron emission display device, but may be applied to other types of electron emission display devices.

As described above, in an electron emission display device having an active area and a non-active area, alignment marks may be formed on at least one of the first and second substrates in the non-active area and patterned after pixels so that the alignment of the first and second substrates within the active area can be checked, and any misalignment can be corrected, thereby making the alignment precise. Further, if corresponding alignment marks are not provided in the other substrate, that substrate may have an alignment reference, e.g., a dummy structure, therein. Finally, subsidiary alignment marks may be provided within opaque regions of the active area.

Exemplary embodiments of the present invention have been disclosed herein, and although specific terms are employed, they are used and are to be interpreted in a generic and descriptive sense only and not for purpose of limitation. For example, the structure of the electron emission unit may be altered. Accordingly, it will be understood by those of ordinary skill in the art that various changes in form and details may be made without departing from the spirit and scope of the present invention as set forth in the following claims.

What is claimed is:

1. An electron emission display device comprising:

first and second substrates facing each other with a non-active area and an active area having a plurality of pixels forming a display area, the non-active area substantially surrounding the display area;

a first pixel portion formed on the first substrate;

a second pixel portion formed on the second substrate; and one or more alignment marks formed in the non-active area of at least one of the first and the second substrates, the alignment marks having a pattern substantially similar to that of the plurality of pixels, and the alignment marks being transparent portions formed in the non-active area.

2. The electron emission display device as claimed in claim 1, wherein the alignment marks are arranged external to a periphery of the display area.

3. The electron emission display device as claimed in claim 2, wherein the active area is formed in the shape of a rectangle, and the alignment marks are formed external to two corners of the display area that diagonally face each other.

4. The electron emission display device as claimed in claim 2, wherein the alignment marks are formed external to four corners of the display area.

5. The electron emission display device as claimed in claim 2, wherein the alignment marks are formed along portions of opposite sides of the display area.

6. The electron emission display device as claimed in claim 1, wherein the alignment marks are formed external to the active display area.

7. The electron emission display device as claimed in claim 1, wherein the second pixel portion comprises:

phosphor layers formed on the second substrate corresponding to pixels; and an opaque layer disposed between the respective phosphor layers, wherein the opaque layer extends into the non-active area forming a first extension and the alignment marks are transparent portions in first extension.

8. The electron emission display device as claimed in claim 7, wherein the transparent portions are openings.

9. The electron emission display device as claimed in claim 1, wherein the first pixel portion comprises:

electron emission regions;

driving electrodes for controlling the emission of electrons from the electron emission regions; and a focusing electrode formed over the driving electrodes, wherein the focusing electrode extends into the non-active area forming a second extension and the alignment marks are openings formed in the second extension.

10. The electron emission display device as claimed in claim 1, wherein the alignment marks comprise first transparent alignment marks on the first substrate and second transparent alignment marks on the second substrate, corresponding to the first transparent alignment marks.

11. The electron emission display device as claimed in claim 1, further comprising dummy pixel regions on the other substrate corresponding to the alignment marks.

12. The electron emission display device as claimed in claim 11, wherein the alignment marks are arranged external to a periphery of the display area.

13. The electron emission display device as claimed in claim 11, wherein:

the first pixel portion comprises, electron emission regions, driving electrodes for controlling the emission of electrons from the electron emission regions, and a focusing electrode formed over the driving electrodes; and the second pixel portion comprises, phosphor layers corresponding to pixels, and an opaque layer disposed between phosphor layers.

14. The electron emission display device as claimed in claim 13, wherein the opaque layer extends into the non-active area, forming a first extension, and alignment marks are transparent portions in the first extension, and the first pixel portion includes at least one of electron emission regions, driving electrodes and the focusing electrode corresponding to the alignment marks to form the dummy pixel regions.

15. The electron emission display device as claimed in claim 13, wherein the focusing electrode extends into the non-active area, forming a second extension, the alignment marks are transparent portions in the second extension, and the second pixel portion includes a phosphor layer corresponding to the alignment marks to form the dummy pixel regions.

16. The electron emission display device as claimed in claim 11, wherein the dummy pixel regions are transparent.

17. The electron emission display device as claimed in claim 1, further comprising subsidiary alignment marks formed in opaque regions within the display area.

18. The electron emission display device as claimed in claim 17, wherein the second pixel portion comprises:

phosphor layers corresponding to pixels; and an opaque layer disposed between phosphor layers, wherein the subsidiary alignment marks are holes in the opaque layer.

19. The electron emission display device as claimed in claim 17, wherein the first pixel portion comprises:

electron emission regions;

driving electrodes for controlling the emission of electrons from the electron emission regions; and a focusing electrode formed over the driving electrodes, wherein the subsidiary alignment marks are holes in at least one of the focusing electrode and the driving electrodes.

20. The electron emission display device as claimed in claim 11, wherein the alignment marks are discrete elements from the dummy pixel regions.

* * * * *